US009457396B2

(12) United States Patent
Yaokawa et al.

(10) Patent No.: US 9,457,396 B2
(45) Date of Patent: Oct. 4, 2016

(54) FREE CASTING METHOD, FREE CASTING APPARATUS, AND CASTING

(71) Applicant: TOYOTA JIDOSHA KABUSHIKI KAISHA, Toyota-shi, Aichi-ken (JP)

(72) Inventors: Jun Yaokawa, Nisshin (JP); Yasushi Iwata, Miyoshi (JP); Yoshio Sugiyama, Seto (JP); Hiroaki Iwahori, Aichi-gun (JP); Norihiro Amano, Kasugai (JP); Noriyuki Ueno, Toyota (JP); Takehito Kobayashi, Miyoshi (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 14/644,914

(22) Filed: Mar. 11, 2015

(65) Prior Publication Data

US 2015/0239038 A1 Aug. 27, 2015

Related U.S. Application Data

(62) Division of application No. 13/821,727, filed as application No. PCT/JP2011/005124 on Sep. 12, 2011, now Pat. No. 9,120,146.

(30) Foreign Application Priority Data

Sep. 17, 2010 (JP) ..... 2010-209761

(51) Int. Cl.
*B22D 11/01* (2006.01)
*B22D 11/14* (2006.01)
(Continued)

(52) U.S. Cl.
CPC ..... *B22D 11/01* (2013.01); *B22D 11/041* (2013.01); *B22D 11/05* (2013.01); *B22D 11/145* (2013.01); *B22D 27/045* (2013.01)

(58) Field of Classification Search
CPC ..... B22D 11/01; B22D 11/041; B22D 11/05; B22D 11/145; B22D 27/045
USPC ..... 164/418, 444, 459; 420/591
See application file for complete search history.

(56) References Cited

U.S. PATENT DOCUMENTS 6,217,803 B1 4/2001 Uozumi
2009/0199391 A1 8/2009 Hennig et al.

FOREIGN PATENT DOCUMENTS

DE 1 286 510 B 1/1969
DE 10 2005 059 692 A1 6/2007
(Continued)

OTHER PUBLICATIONS

Jun. 2, 2014 Office Action issued in Australian Application No. 2011303303.
(Continued)

*Primary Examiner* — Alexander Polyansky
(74) *Attorney, Agent, or Firm* — Oliff PLC

(57) ABSTRACT

A free casting method according to the present invention includes, a lead-out step for leading out molten metal from a lead-out area (P) provided in a source of supply, e.g. a surface level of the molten metal, to retain the molten metal temporarily by surface films (F) generated on an outer surface, and a forming step for obtaining a formed body by solidifying retained molten metal (MS) led out along a set passage (L1) depending on a desired casting shape, wherein the retained molten metal is solidified after being formed into the desired casting shape by applying an external force thereto at positions between an unrestrained root portion of the retained molten metal in vicinity of the surface level of the molten metal and a solidification interface defined as a boundary between the retained molten metal and the formed body in the forming step.

3 Claims, 4 Drawing Sheets

(51) Int. Cl.

| | |
|---|---|
| ***B22D 27/04*** | (2006.01) |
| ***B22D 11/05*** | (2006.01) |
| ***B22D 11/041*** | (2006.01) |

(56) References Cited

FOREIGN PATENT DOCUMENTS

| | | | |
|---|---|---|---|
| DE | 10 2006 004 310 | A1 | 8/2007 |
| JP | 59-203798 | A | 11/1984 |
| JP | 60-122791 | A | 7/1985 |
| JP | 63-199050 | A | 2/1987 |
| JP | 63-199050 | A | 8/1988 |
| JP | 02-205232 | A | 8/1990 |
| JP | 02-251341 | A | 10/1990 |
| JP | 03-291333 | A1 | 12/1991 |
| JP | 09-248657 | A | 9/1997 |
| SU | 112624 | A1 | 11/1957 |
| SU | 1076181 | A1 | 2/1984 |

OTHER PUBLICATIONS

May 4, 2014 Office Action issued in Chinese Application No. 201180044654.9.

Apr. 29, 2014 Office Action issued in Russian Application No. 2013111545.

Jul. 17, 2014 Office Action issued in Korean Application No. 10-2013-7006758.

Jul. 19, 2013 Office Action issued in Japanese Application No. 2010-209761.

Nov. 15, 2014 Office Action issued in Chinese Application No. 201180044654.9.

Feb. 5, 2015 Office Action issued in Korean Application No. 10-2013-7006758.

R-AXIS VERTICAL PLANE

θ-AXIS VERTICAL PLANE

Z-AXIS VERTICAL PLANE

WHITENED PART : COLUMNAR STRUCTURE IN α PHASE (Al HAVING FCC STRUCTURE)

BLACKENED PART : $Mg_2Si$ PHASE CRYSTALLIZED AMONG THE α - PHASE COLUMNAR STRUCTURE

FREE CASTING METHOD, FREE CASTING APPARATUS, AND CASTING

This application is a divisional application of U.S. application Ser. No. 13/821,727 filed on Mar. 8, 2013, which in turn is a national phase application of PCT/JP2011/005124 filed on Sep. 12, 2011 and claims priority to Japanese Application No. 2010-209761 filed on Sep. 17, 2010. The prior applications, including the specification, drawings and abstracts are incorporated herein by reference in their entirety.

TECHNICAL FIELD

The present invention relates to a breakthrough casting method (hereinafter, called "free casting method") which is capable of obtaining a casting without using a casting mould which was conventionally believed to be indispensable for casting, and a free casting apparatus suitably used for the method, and a casting obtained by the method and the apparatus.

BACKGROUND ART

Metal products formed in complicated shapes are often produced by casting. Casting is a production process in which metal having fluidity (molten metal) is solidified in a desired shape to obtain a target casting. It is technical common knowledge long believed that a casting mould having a cavity suitable for a desired shape of a target casting is an indispensable device for casting. Therefore, the casting methods conventionally employed often led to a variety of problems caused by using the casting moulds. The problems are, for example, casting defects (solidification cracking, shrinkage porosity, gas blow holes, etc.), ununiformity of solidified structure, deterioration of material yield, environmental burden, or the like. A number of technical approaches have been proposed to solve each of the conventional problems from a microscopic point of view.

Apart from these technical approaches, some technical solutions were disclosed, which address the problems differently from the conventional casting methods in which casting moulds are used. The patent literatures which recite examples of such a casting technique are listed below.

CITATION LIST

Patent Literature

[PTL 1]
Japanese Unexamined Patent Application Publication No. 63-199050
[PTL 2]
Japanese Unexamined Patent Application Publication No. 2-205232
[PTL 3]
Japanese Unexamined Patent Application Publication No. 2-251341
[PTL 4]
Japanese Unexamined Patent Application Publication No. 9-248657

SUMMARY OF INVENTION

Technical Problem

The method disclosed in the Patent Literature 1, however, can only obtain metal materials having simple columnar and bar shapes, failing to accomplish casting that demands a high degree of freedom in shapes.

The methods disclosed in the Patent Literatures 2 to 4 also have a technical disadvantage that an outlet of molten metal is structurally restrained by a mould and a partitioning member provided on a surface level of the molten metal on the side of its source of supply. Therefore, these methods are similarly unable to accomplish such casting that demands a high degree of freedom in shapes, practically failing to obtain a casting having a smoothly curved surface or shape. It would be a matter of course that, in these methods, oxides or the like may adhere to the mould and the partitioning member provided on the surface level of the molten metal, failing to reliably obtain a casting having a desired shape and quality.

The present invention was made in consideration of the above-mentioned circumstances. The object of the present invention is to provide a breakthrough casting method which is capable of easily obtaining castings having complicated shapes by ultimately solving the various technical problems involved in the conventional casting techniques. The present invention further provides an apparatus suitably used for the casting method, and a casting obtained by the casting method.

Solution to Problem

The inventors of the present invention earnestly worked on solving the problems, and finally found out, as a result of the trial-and-error researches and experiments, a casting method in which molten metal can be solidified into a desired shape to obtain a target casting without using a casting mould. The inventors continued to develop the finding to further expand its technical scope, and finally completed the present invention described below.

<Free Casting Method>

(1) A free casting method according to the present invention is a casting method that can obtain castings without using casting moulds, including: a lead-out step for leading out molten metal from its surface level to retain itself temporarily by surface film generated on an outer surface or surface tension, in which the molten metal is supplied to the retained molten metal through the surface level; and a forming step for obtaining a formed body by solidifying the retained molten metal led out along a set passage depending on a desired casting shape, wherein the retained molten metal is solidified after being formed into the desired shape by applying an external force thereto at positions between an unrestrained root portion of the retained molten metal in vicinity of the surface level of the molten metal and a solidification interface defined as a boundary between the retained molten metal and the formed body in the forming step.

(2) The free casting method according to the present invention can solve the conventional technical problems inevitably generated by the conventional casting methods in which casting moulds are used. The present invention can dispense with any casting moulds, which enables a casting to be produced while molten metal is always supplied when solidifying, thereby preventing casting defects that conventionally occur in moulds (for example, solidification cracking, shrinkage porosity, inclusion (gas blow holes)). Because of this technical advantage, the method can be used for casting alloys which are likely to undergo solidification cracking or the like when the conventional methods are employed (for example, JIS 6000-series wrought aluminum alloys or the like), and can easily obtain complicated shaped castings made of the alloys. Thus, the free casting method according to the present invention is available for a wider selection of alloys for obtaining castings.

Further, the method according to the present invention can dispense with any casting moulds to obtain castings, thereby remarkably improving a degree of freedom in shapes of castings. Therefore, such castings that are conventionally difficult to obtain can be inexpensively produced by the method. For example, undercut-shaped castings and long-shaped castings that are difficult to obtain can be easily produced by the free casting method according to the present invention. The free casting method according to the present invention makes it unnecessary to prepare any particular production equipment or production steps to be used depending on types of castings or casting moulds. This favorably results in reduction of manufacturing costs, improvement of manufacturing flexibility such as enabling small-lot production with a variety of products, downsizing of a production equipment, improvement of an in plant environment, or the like.

Because the surface of the mould cavity does not affect the solidification of the molten metal in the free casting method according to the present invention, it is easy to control a cooling rate and a solidification direction, and thereby obtain a high quality casting with well controlled solidification structure.

Further, the free casting method according to the present invention can significantly reduce an amount of molten metal used for a portion other than a product per se, thereby achieving a remarkable improvement of material yield and a large reduction of return scrap. The free casting method according to the present invention makes it unnecessary to melt and retain a large amount of molten metal before casting a large-size product by melting raw materials little by little depending on demands. The method thus can reduce a use of metal material and also save energy required for casting. Thus, the free casting method according to the present invention can make a great deal of contribution to resource saving, energy saving, and less environmental burden (for example, reduction of $CO_2$ emission).

(3) As described so far, the present invention provides an excellent casting method which ultimately solves various technical problems generated by the conventional casting methods. Though details of an exact mechanism of the casting method according to the present invention have not been precisely identified, we are presently considering the mechanism as described below.

The molten metal is in liquid state or solid-liquid coexisting state, therefore, have fluidity. Therefore, the molten metal does not have any specific shape unless its shape is defined by a casting mould or the like (the surface of the mould cavity), which means the molten metal is usually not maintained (retained) in any particular shape.

However, when a solid (inducing body) is brought into contact with a surface of the molten metal and slowly lifted upward, the molten metal in a particular shape is lifted upward alongside by about several tens of millimeters without using a casting mould or the like. The molten metal is thus considered to be retained at least by a surface film (for example, oxide film) or surface tension generated on a surface of the raised molten metal.

The molten metal thus retained (retained molten metal) is unsolidified; therefore, its shape is temporary or transitional. Therefore, the retained molten metal can have its shape variously changed depending on a direction or a passage in which the molten metal is guided or an external force or the like applied thereto from outside. When the retained molten metal is thus shaped suitably for a desired casting and then cooled to be solidified, a casting having the desired shape can be obtained even without using a casting mould. Because the root portion of the retained molten metal in vicinity of the surface level of the molten metal is unrestrained, the shape of the retained molten metal has a very high degree of freedom. Therefore, a casting can be easily formed in a complicated shape. The free casting method according to the present invention can efficiently obtain complicated shaped castings without causing casting defects.

There are different methods for cooling the retained molten metal to be solidified, examples of which are: a method of cooling the retained molten metal by directly blowing a coolant gas thereto, and a method of cooling the retained molten metal indirectly by using a metal inducing body or an already-solidified portion of the molten metal. One of the cooling methods may be used, or some of the methods may be combined.

When the retained molten metal is indirectly cooled by using the already-solidified portion, the cooling methods can be applied directionally from the already-solidified portion to an unsolidified portion. This helps to obtain a sound casting in which such a casting defect as shrinkage porosity is avoided. Further, the free casting method according to the present invention can easily obtain a high quality casting having a directional solidified structure which is difficult to obtain by the conventional casting methods in which casting moulds are used.

According to the free casting method wherein the molten metal is not cooled in a casting mould, solidification cracking, which is possibly generated in the conventional casting methods due to restriction of thermal construction by the casting moulds, is prevented to occur. Because of this technical advantage, it is possible in the method to obtain castings made of alloys, such as 6000-series (JIS) wrought aluminum alloys, which are likely to undergo solidification cracking in the conventional casting methods.

<Free Casting Apparatus>

The present invention is applicable not only to the free casting method described so far but also to a free casting apparatus suitably used for the method. A free casting apparatus according to the present invention comprises a crucible in which molten metal is contained, and a shape providing member configured to apply an external force to retained molten metal led out from a surface level of the molten metal contained in the crucible and temporarily retained by a surface film or surface tension generated on an outer surface to form the retained molten metal into a shape. The casting apparatus thus structurally characterized can be used for the free casting method.

The free casting apparatus preferably further comprises a drive source configured to guide an inducing body having a solid for inducing a basic shape designed for obtaining a desired casting shape along a set passage depending on the desired casting shape from the surface of the molten metal in the crucible. The free casting apparatus preferably further comprises a nozzle used to blow fluid to an outer surface of the retained molten metal or an outer surface of a formed body obtained by solidifying the retained molten metal.

<Casting>

The present invention is also applicable to a casting obtained by the free casting method and the free casting apparatus described so far. A casting according to the present invention preferably has directional solidified structure in which solidified structure is directionally arranged.

<Others>

(1) The material, shape, and dimension of the casting according to the present invention are not particularly limited.

(2) Unless otherwise stated, "x-y" recited in the specification of the present invention includes a lower-limit value x and an upper-limit value y. The upper-limit value and lower-limit value recited in the specification of the present invention can be variously combined and expressed in such a numeral range as "a-b". Any arbitrary numeral values included in the technical scope recited in the specification can be used as an upper-limit value and a lower-limit value to set a numeral range.

REFERENCE SIGNS LIST

Figure 1:
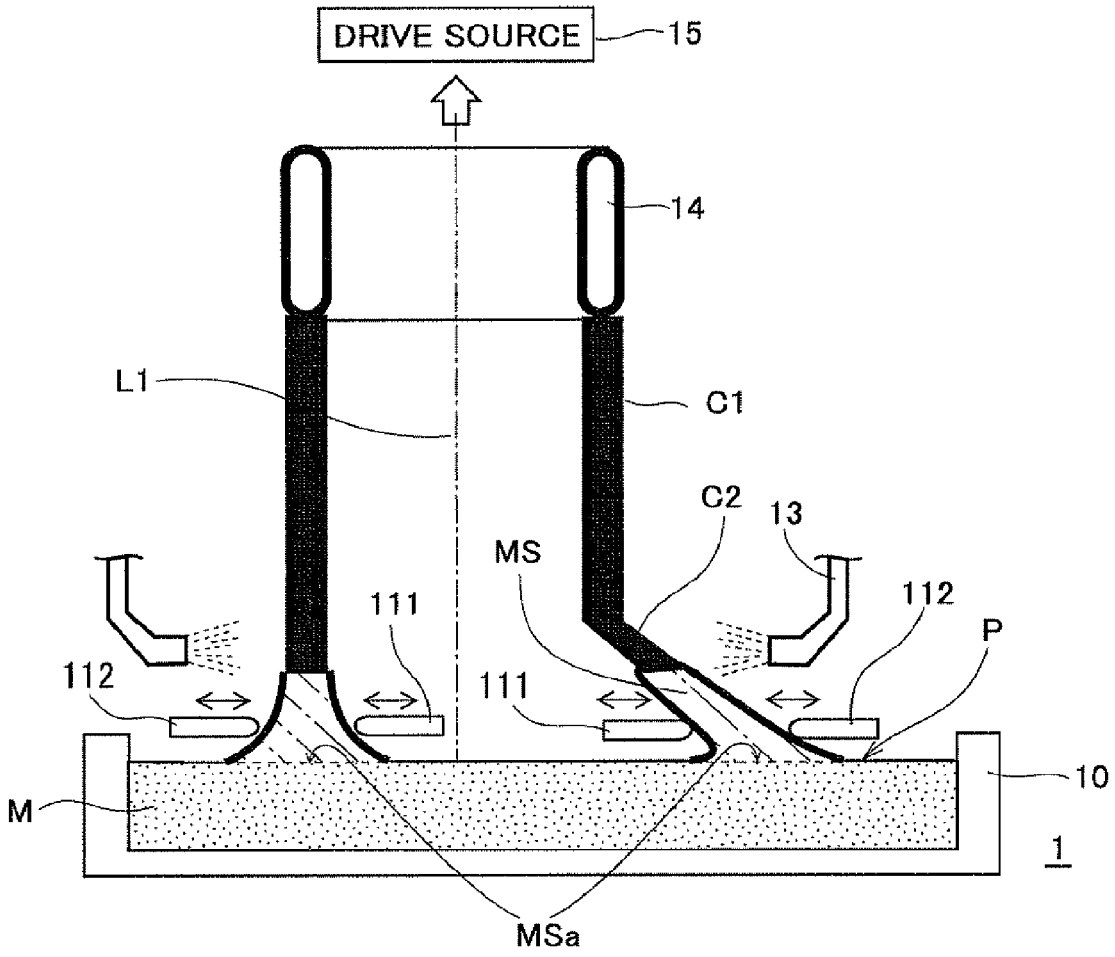
FIG. 1 is a conceptual view of a free casting apparatus.

1 free casting apparatus
10 crucible
11 shape providing members
13 cooling nozzle (nozzle)
14 starter (inducing body)
15 drive source
M molten metal
MS retained molten metal
MSa root portion
C1, C2 casting
L1 passage (set passage)
G coolant

DESCRIPTION OF EMBODIMENTS

The present invention will be described more specifically by way of embodiments. Description of this specification including the following description of embodiments can be appropriately applied not only to a free casting method and a free casting apparatus but also to a casting obtained by the method and the apparatus according to the present invention. One or more of the following constituent features can be arbitrarily added to the abovementioned constitution of the present invention. A constitutional feature about a casting method can be regarded as that of a casting when it is understood as a product by process. It should be noted that the most appropriate embodiment depends on a target application, required characteristics or the like.

<Free Casting Method>

Main steps included in the free casting method according to the present invention are a lead-out step and a forming step.

<Lead-Out Step>

(1) The lead-out step is a step in which a part of molten metal contained in a container such as a crucible is led out from a source of supply, e.g. a surface level of the molten metal, to retain itself depending on a desired shape of a casting. When castings are continuously produced, the lead-out step and the forming step work as a sequence of steps.

A lead-out area where retained molten metal is led out is located in vicinity of a boundary between the surface level of the molten metal contained in the crucible and the retained molten metal, and a root portion of the retained molten metal is formed near the lead-out area.

(2) The retained molten metal is preferably led out by, for example, using an inducing body provided for inducing a basic shape designed for obtaining the desired casting shape and bringing the inducing body into contact with the molten metal in the lead-out area and lifting the inducing body upward. Accordingly, the retained molten metal can be stably retained, and the casting can be formed in a steady shape. Another advantage of leading out the retained molten metal in this manner is that the retained molten metal can be transferred by using the inducing body in the forming step.

The inducing body has such a shape that is suitable for the basic shape (for example, circular shape, annular shape). The inducing body may be made of any material as far as the molten metal is adhered thereto. For directional solidification of the molten metal in a direction from the inducing body to the lead-out area or the like, the inducing body is preferably a metal body (solid material) superior in heat transmission (heat conductivity, heat transference). The material of the inducing body then is not necessarily the same metal as the molten metal.

(3) An atmosphere where the retained molten metal is led out is not particularly limited. When the retained molten metal is led out under atmosphere or oxidation atmosphere, an oxide film is generated as a surface film on an outer surface of the retained molten metal. When the retained molten metal is led out under nitrogen atmosphere, a nitride film is generated as a surface film thereon. Even when the retained molten metal is led out under such an atmosphere that no surface film is generated, the retained molten metal can be retained by surface tension generated on the surface of the molten metal.

<Forming Step>

(1) The forming step is a step in which the retained molten metal is solidified while being guided depending on a desired shape of the casting so that a formed body (casting) having a desired shape is obtained. As described earlier, the retained molten metal, though having a temporarily retained shape, is unsolidified. Therefore, the retained molten metal can be formed in a desired shape by regulating and adjusting a passage where it travels after the lead-out step and an external force applied thereto.

The retained molten metal having the unrestrained root portion can be easily formed in various complicated shapes. The retained molten metal is guided to have a desired shape by using a shape providing member (a tool such as pallet, guide, or roller) brought into contact with the retained molten metal or by blowing a flow-controlled or pressure-controlled fluid (gas) to apply fluid pressure thereto. Then, the retained molten metal can be formed in various complicated shapes, and a casting having an arbitrary shape can be consequently obtained. The retained molten metal can be guided to have a desired shape not only from the side of an outer surface but also from the side of an inner surface of the retained molten metal. When the retained molten metal is guided to have a desired shape from the sides of its outer surface and inner surface, the thickness of the retained molten metal as well as the shape thereof can be easily adjusted or regulated.

Since the retained molten metal is thus shaped and formed, castings having shapes so far difficult to obtain by the conventional casting methods in which casting moulds are used (for example, undercut-shaped casting) can be easily obtained. This facilitates the production of castings having shapes which may be difficult to obtain by simply controlling the movement of the retained molten metal along a set passage described below.

The passage where the retained molten metal is guided is preferably an ascending passage having at least an ascending component, because the retained molten metal can be more easily guided and controlled when pulled upward (lift-up step). The set passage may be a straight, curved or spiral passage vertically extending upward. The set passage may be a regularly-configured passage or an irregularly-configured passage.

(2) Examples of methods for cooling the retained molten metal are directional solidification by using the inducing body or already-solidified portion, and cooling solidification by blowing any of various coolants to the retained molten metal or the formed body near a solidification interface from the sides of inner and outer surfaces thereof. The coolants may be blown to the retained molten metal in order to not only cool but also shape the retained molten metal. Examples of the coolant are gas such as air, nitrogen gas or inactive gas, or liquid such as water. When the liquid is used as the coolant, the retained molten metal can be speedily and efficiently cooled by the heat of vaporization. Particularly when the liquid is sprayed depending on a quantity of solidification heat of the retained molten metal, the liquid used as the coolant is prevented from dropping on the molten metal, and the coolant can be easily recovered.

When nozzles are provided on outer or inner sides of the retained molten metal, the coolant can be easily sprayed. How many nozzles are provided and where they are located may be suitably decided depending on any desired shape and solidified structure of the casting. When, for example, a plurality of nozzles or an annular nozzle is provided on the outer side of the retained molten metal, the whole retained molten metal can be evenly cooled. As a result, a casting having orderly solidified structure can be obtained.

<Molten Metal>

The type of the molten metal is not particularly limited. The metal may be iron, aluminum, magnesium, or titanium, or an alloy obtained from any of these metals. The "molten metal" recited in the specification of the present invention is not necessarily limited to a metal whose whole content is in liquid phase. The molten metal may be a metal in solid-liquid coexisting phase in which solid phase is mixed with liquid phase, in which case the solid phase and the liquid phase are not necessarily made of the same material. The molten metal may be composite materials.

<Others>

The intended end-usage of the casting according to the present invention is not particularly limited. The casting may be a nearly final product or a material to be further processed later before finalized (intermediate material). The present invention can easily and inexpensively obtain castings having complicated shapes or solidified structure so far difficult to obtain by the conventional casting methods in which casting moulds are used. Therefore, the casting according to the present invention can be used in a broad range of products in technical fields where castings were not conventionally used.

EXAMPLE 1

The present invention is described in further detail referring to examples.

<Free Casting Apparatus>

Figure 2:
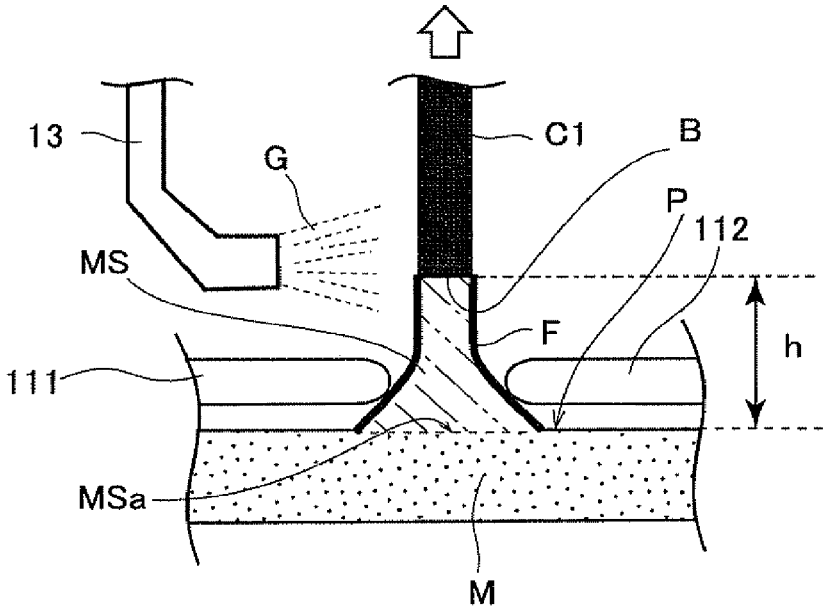
FIG. 2 is a partially enlarged view of the free casting apparatus shown in FIG. 1.

(1) FIG. 1 is a conceptual view of a free casting apparatus 1. FIG. 2 is an enlarged view of a part of the free casting apparatus shown in FIG. 1. The free casting apparatus 1 has a crucible 10 in which molten metal M is contained, and an inner shape providing member 111 and an outer shape providing member 112 provided shortly above a surface level of the molten metal M in the crucible 10 (which are collectively called "shape providing members 11"), a plurality of cooling nozzles 13 provided in an upward direction of the shape providing members 11 from which a coolant G is blown out approximately annularly, a starter 14 (inducing body) made of metal and having an annular shape in section, and a drive source 15 which lifts up the starter 14.

The drive source 15 can control a lift-up speed (ascending speed) of the starter 14 and a lift-up direction (moving direction) of the starter 14. The starter 14 is movable along an ascending passage (set passage) arbitrarily configured. The amount of the coolant G (air is used in Example 1) blown from the cooling nozzles 13 and its blow-out pressure may be arbitrarily controlled by a controller separately provided (not shown in the drawings).

(2) When the molten metal M is guided by the starter 14 and pulled upward from a lead-out area P of the crucible 10 (lift-up step), an annular and thin surface film F (oxide film) is generated on outer surfaces of the molten metal M on inner and outer surfaces thereof. These surface films F (or surface tension of the molten metal M) form retained molten metal MS led out and retained in an annular (conical) shape.

Since the retained molten metal MS is retained by the surface films F, the retained molten metal MS extends upward to around a height h from the surface level of the molten metal M in the crucible 10. The height h or a height nearby is a solidification interface B where the liquid phase changes to the solid phase. In an upward direction of the solidification interface B, the retained molten metal MS is solidified so that a casting C1 (formed body) having a desired shape (for example, annular shape) is obtained. The solidification direction of the casting C1 cooled by the heat removal from the starter 14 and by the coolant G blown thereto from the cooling nozzles 13 is a direction from the starter 14 to the lead-out area P. Therefore, the casting C1 has directional solidified structure formed in a direction where the casting C1 extends.

An annular root portion MSa of the retained molten metal MS formed in vicinity of the lead-out area P of the molten metal is unrestrained. When the shape providing members 11 in contact with the retained molten metal MS are respectively moved rightward and leftward, the root portion MSa can freely change its shape in accordance with the behaviors of the shape providing members 11. As a result, the retained molten metal MS is free of any restraint and can be easily changed into any complicated shapes by the shape providing members 11.

<Free Casting>

(1) A casting actually produced by the free casting apparatus 1 is described below.

The wrought aluminum (Al) alloy (JIS A6063), which is conventionally known as a metal difficult to cast because solidification cracking or the like is likely to occur, was used as the metal material of the molten metal M. The prepared metal material was melted and put in the crucible 10, and then held at 680 deg. C.

The inner shape providing member 111 floated on the surface of the molten metal M was a heat insulation member having a disc shape and formed in the size of D (diameter) 40 mm×thickness of 3 mm. The outer shape providing member 112 was a heat insulation member having a ring shape and formed in the size of inner diameter of D60 mm×outer diameter of D100 mm×thickness of 3 mm. The lead-out area P was formed by the shape providing members 11 and had an annular shape with a clearance of 10 mm (inner diameter of D40 mm×outer diameter of D60 mm).

The starter 14 was a cylindrical member made of steel and formed in the size of inner diameter of D44 mm×outer diameter of D56 mm×height of 100 mm. The eight cooling nozzles 13 were equally spaced in an annular shape in an upward direction of the shape providing members 11. The respective cooling nozzles 13 blew air at about 30 deg. C. at the rate of 200 L/min.

(2) The starter 14 was brought into contact with the surface of the molten metal M in the lead-out area P. As soon as the solidification of the molten metal M started on the lower-end side of the starter 14, the starter 14 was lifted upward along a linear passage L1 (set passage) at the ascending speed of 40 min/min with the air continuously blown from the eight cooling nozzles 13. Then, the retained molten metal MS retained by the surface films F (oxide films) (lead-out step, lift-up step) was let out, and the casting C1 having a cylindrical shape and directionally solidified in an upward direction of the solidification interface B (forming step) was formed. The casting C1 was formed in the size of outer diameter of D55 mm×thickness of 5 mm.

Figure 3:
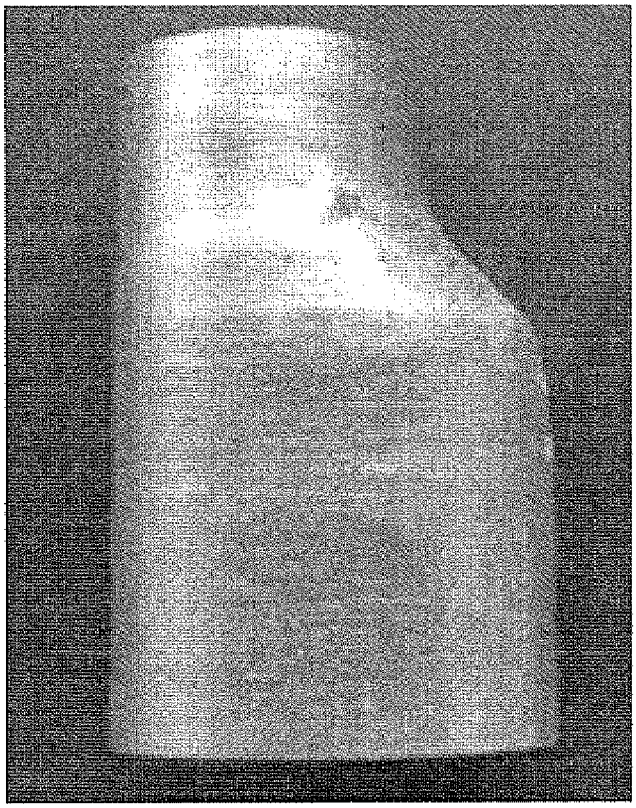
FIG. 3 is an image of a casting obtained by free casting.
Figure 4A:
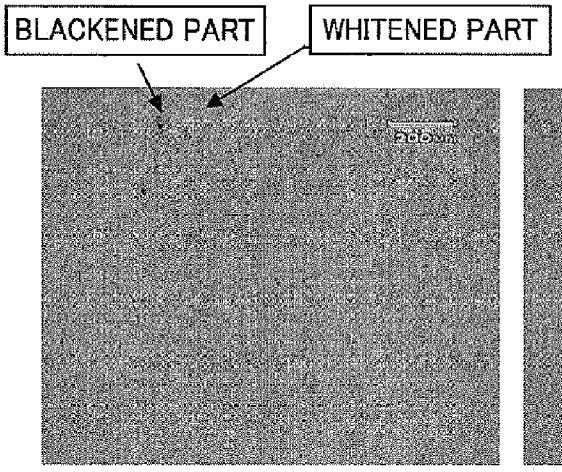
FIG. 4A is a microscopic image of the micro structure of the casting on an R-axis vertical plane.
Figure 4B:
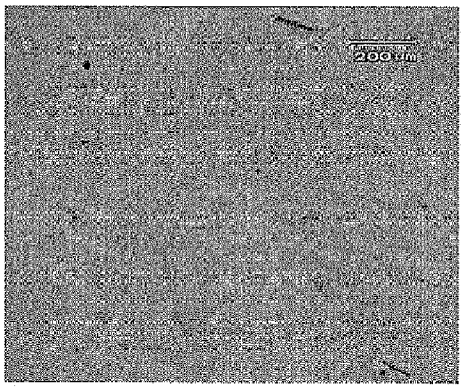
FIG. 4B is a microscopic image of the micro structure of the casting on a theta-axis vertical plane.
Figure 4C:
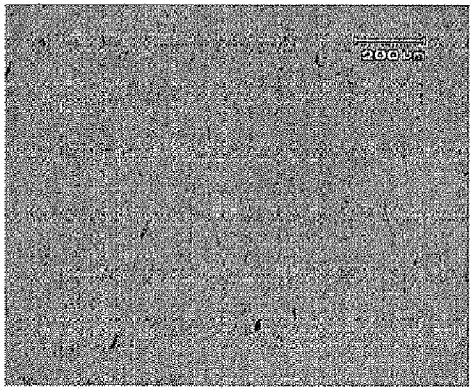
FIG. 4C is a microscopic image of the micro structure of the casting on a Z-axis vertical plane.
Figure 4C:
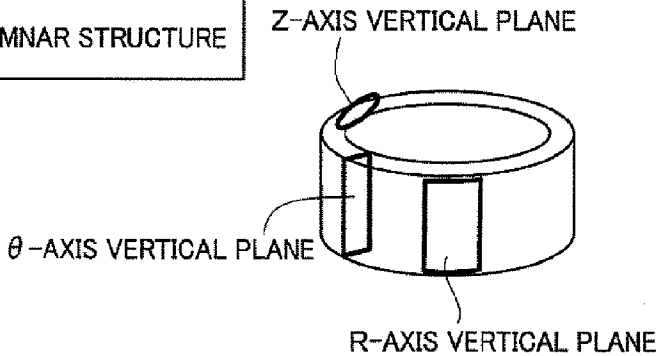

In an intermediate stage of the forming step, the shape providing members 11 were put in action. That is to say, the inner shape providing member 111 and the outer shape providing member 112 were moved such that the root portion MSa of the retained molten metal MS expanded its diameter. As a result, a casting C2 having a cylindrical shape and an elliptical shape in section and formed in the size of largest outer diameter of 80 mm×smallest outer diameter of 55 mm×thickness of 4 mm was obtained. FIG. 3 is an image of the casting C1 and the casting C2 (collectively called "castings C"). The obtained castings C showed no casting defect such as shrinkage porosity or solidification cracking and had a smooth and fine casting surface.

(3) FIG. 4 are microscopic images of the micro structure of the casting C1. FIGS. 4A to 4C are respectively the microscopic images of the micro structures on a radially vertical plane (R-axis vertical plane), a circumferentially vertical plane (theta-axis vertical plane), and a vertical plane in the extending direction (Z-axis vertical plane). It is known from these images that the casting C1 has favorable directional solidified structure. In the images, a whitened part is columnar structure which is an alpha-phase primary crystal grown in the lift-up direction (A1 in FCC structure), and a blackened part is an $Mg_2Si$ phase finally crystallized after the columnar structure is grown.

EXAMPLE 2

Free Casting Method

Figure 5:
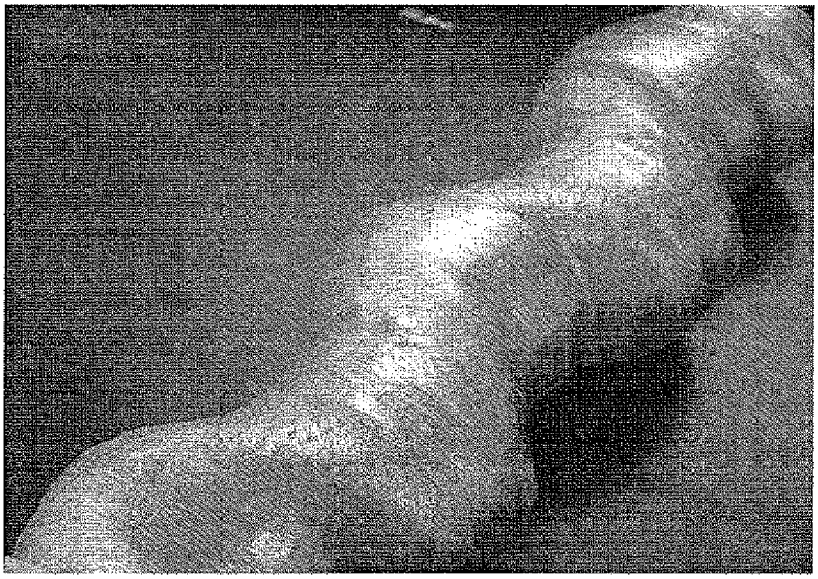
FIG. 5 is an image of another casting obtained by the free casting.
Figure 6:
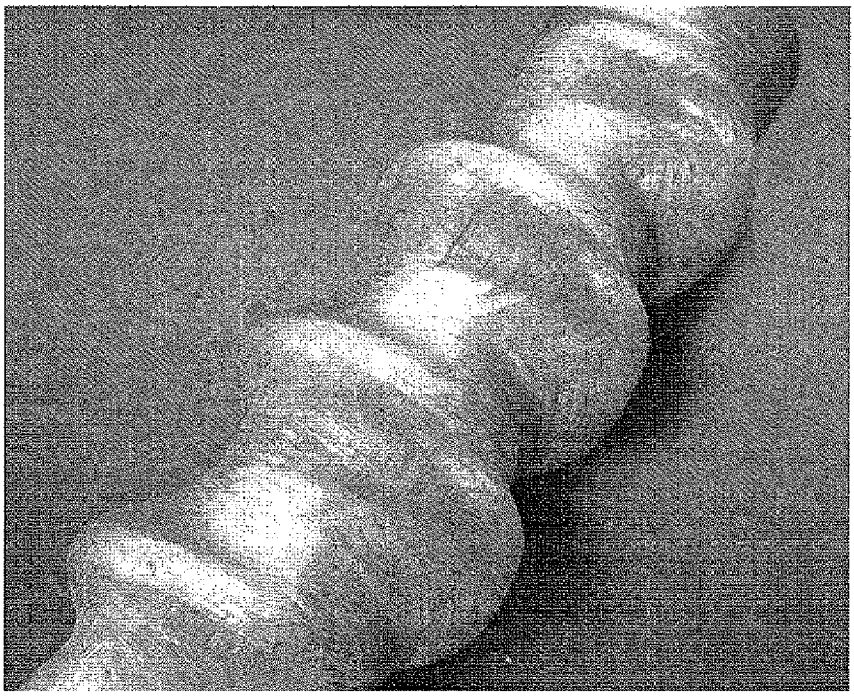
FIG. 6 is an image of still another casting obtained by the free casting.

FIGS. 5 and 6 are images of another casting obtained by the free casting apparatus 1. To obtain a casting C3 shown in FIG. 5, the horizontal (rightward and leftward) moving speed of the starter 14 and the ascending speed of the starter 14 were set to 1:1, and the retained molten metal MS was guided along a zig-zag passage (set passage) tilted from the vertical direction by about 45 degrees and then formed. The casting C3 also had directional solidified structure. The casting C3 showed no casting defect such as shrinkage porosity or solidification cracking, and had a smooth and fine casting surface.

To obtain a casting C4 shown in FIG. 6, the traveling passage of the starter 14 (guiding passage of the retained molten metal MS) having the zig-zag shape is changed to a passage having a spiral shape (set passage), and the retained molten metal MS is then formed. More specifically, the starter 14 was brought into contact with the molten metal M in the lead-out area P, and the starter 14 was then slightly lifted at the ascending speed of 84 mm/min (lead-out step, lift-up step). With the ascending speed constantly sustained, the starter 14 was then moved at the circumferential speed of 28 mm/min along the outer periphery of a radius 10 mm (D20 mm). The casting C4 thus obtained also had directional solidified structure. The casting C4 showed no casting defect such as shrinkage porosity or solidification cracking, and had a smooth and fine casting surface.

When the shape providing members are used to form the castings shown in FIGS. 5 and 6, castings having extremely complicated shapes can be efficiently obtained with a high product quality ensured at the same time.

The invention claimed is:

1. A free casting apparatus for making a casting free of a casting mold, the apparatus comprising:

a crucible configured to contain molten metal; and a shape providing member configured to move laterally along a surface level of the molten metal contained in the crucible and to apply an external force to molten metal drawn up from the surface level of the molten metal contained in the crucible along a set passage to a solidified formed body, wherein the molten metal drawn up from the surface level is retained within a surface film generated by a surface tension on an outer surface of the molten metal along the set passage to form an unrestrained root portion of unsolidified retained molten metal at an interface between the surface level of the molten metal in the crucible and the retained molten metal in the set passage, and the shape providing member moves the unrestrained root portion of the unsolidified retained molten metal with respect to the solidified formed body along the surface level.

2. The free casting apparatus as claimed in claim 1, further comprising a drive source configured to guide an inducing body for inducing a basic of the casting, the inducing body configured to obtain a desired casting shape along the set passage as the molten metal is being drawn out of the crucible.

3. The free casting apparatus as claimed in claim 1, further comprising a nozzle configured to blow fluid to an outer surface of the retained molten metal or an outer surface of the solidified formed body obtained by solidifying the retained molten metal.

* * * * *